United States Patent [19]
Misumi et al.
[11] 4,215,180
[45] Jul. 29, 1980

[54] OXIDE-COATED CATHODES FOR ELECTRON TUBES

[75] Inventors: Akira Misumi; Yukio Suzuki; Kazuo Sunahara, all of Mobara, Japan

[73] Assignee: Hitachi, Ltd., Tokyo, Japan

[21] Appl. No.: 4,573

[22] Filed: Jan. 18, 1979

[30] Foreign Application Priority Data

Apr. 24, 1978 [JP] Japan ..... 53-47789

[51] Int. Cl.[2] ..... H01J 1/15

[52] U.S. Cl. ..... 428/553; 313/311; 313/341; 427/77; 427/111; 427/122; 428/368; 428/389; 428/471; 428/472; 428/623; 428/632; 428/633; 428/634; 428/680

[58] Field of Search ..... 428/550, 553, 564, 678, 428/680, 622, 623, 632-634, 367, 368, 389, 471, 472; 427/77-78, 111, 112, 122; 313/311, 340, 341, ; 148/31.5

[56] References Cited

U.S. PATENT DOCUMENTS

| | | | |
|---|---|---|---|
| 2,438,732 | 3/1948 | Williams | 428/368 |
| 3,446,607 | 5/1969 | Volk et al. | 428/634 |
| 3,500,454 | 3/1970 | Emerick | 313/311 |
| 3,539,859 | 11/1970 | Bongle | 313/311 |
| 3,769,084 | 10/1973 | Saito et al. | 428/634 |
| 3,826,946 | 7/1974 | Hummer et al. | 313/311 |
| 4,081,713 | 3/1978 | Misumi | 313/346 R |
| 4,129,801 | 12/1978 | Soeno et al. | 313/346 R |

*Primary Examiner*—L. Dewayne Rutledge
*Assistant Examiner*—Michael L. Lewis
*Attorney, Agent, or Firm*—Craig & Antonelli

[57] ABSTRACT

An oxide-coated cathode for electron tubes which comprises a base metal plate made of an alloy comprising nickel as a main component and 2% by weight or more of at least one high-melting point metal, an oxide layer coated on the base metal plate comprising at least one oxide of a reducing element, a carbon coating layer coated on the oxide layer, and an alkaline earth oxide layer capable of emitting electrons coated on the carbon coating layer can maintain electron emitting life for a long period of time due to the prevention of interfacial reaction between the base metal plate and the alkaline earth oxide layer by the oxide layer and the carbon coating layer.

13 Claims, 3 Drawing Figures

OXIDE-COATED CATHODES FOR ELECTRON TUBES

This invention relates to oxide-coated cathodes for electron tubes, more particularly oxide-coated cathodes containing as a base metal an alloy comprising at least one high-melting point metal such as W, Mo, Re, Ta, or the like.

Recently, in the case of an electron tube equipped with an oxide-coated cathode, in order to shorten a time required for emitting electrons after turning on a power supply switch, there have been made many proposals such as to make thinner the thickness of the base metal plate of the cathode so as to reduce a heat capacity of the cathode, to use a so-called directly heated type cathode, in which the base metal plate is directly heated by a current flowing therethrough, and the like. In these cases, the base metal was required to have greater mechanical strength at high temperatures than the conventional ones, so that as base metal alloys containing such metals as W, Mo, Re, Ta or the like having high melting points have been used in place of the conventional base metals containing Ni and trace amounts of one or more reducing elements. But these high melting point metals have a property to be easily oxidized comparing with Ni. Therefore, if an oxide-coated cathode is produced by using an alloy containing one or more high-melting point metals as a base metal according to a conventional method, the high melting point metals are oxidized and there takes place a rapid and violent reaction at the interface of the oxides of the high melting point metals and the alkaline earth oxides or the alkaline earth carbonates which are coated on the based metal plate. The reaction rate and the amounts of the reaction products of the interfacial reaction are by far greater beyond comparison with those of the reaction between the conventional base metal containing Ni and trace amounts of one or more reducing elements and the alkaline earth oxides. When the interfacial reaction between the base metal and the alkaline earth oxides takes place in a large amount, there arise various defects in that the contacting state between the base metal and the alkaline earth osices changes greatly, which results in peeling of the alkaline earth oxides from the base metal plate, or the contact between the alkaline earth oxides and the base metal plate becomes insufficient and the temperature of the alkaline earth oxides layer during the operation of cathode is lowered, which results in lowering of electron emission amount from the alkaline earth oxides. These make the cathode impossible for practical uses.

It is an object of the present invention to provide oxide-coated cathodes for electron tubes overcoming the defects mentioned above and being able to prevent the interfacial reaction between the alkaline earth oxides and the base metal plate and to maintain the electron emission life for a long period of time.

The present invention provides an oxide-coated cathode for electron tubes comprising a base metal plate made of an alloy comprising nickel as a main component, and 2% by weight or more of at least one high-melting point metal, an oxide layer, which is coated on the base metal plate, comprising at least one oxide of a reducing element, a carbon coating layer, which is coated on the oxide layer, and an electron emissive alkaline earth oxide layer coated on the carbon coating layer.

BRIEF DESCRIPTION OF DRAWINGS

In the attached drawings.

The present invention is explained in detail referring to FIG. 1. In FIG. 1, numeral 1 denotes the base metal plate, numeral 6 denotes a flat portion of the base metal plate, numeral 2 denotes terminals which are connected to a power source not shown in the drawing, numeral 3 denotes the oxide layer, numeral 4 denotes the carbon coating layer, and numeral 5 denotes the alkaline earth oxide layer.

Figure 1:
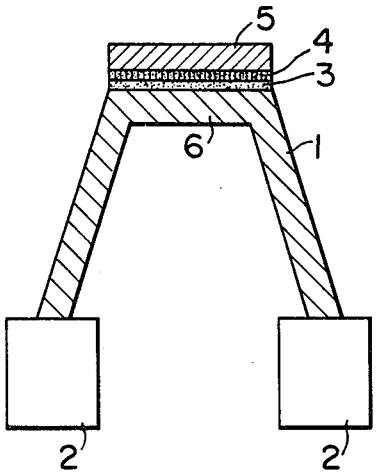
FIG. 1 is a sectional view of the principal portion of an oxide-coated cathode according to the present invention; each of FIGS. 2 and 3 is a graph showing the relationship between the value of the maximum anode current and operation time of the oxide-coated cathode when the cathode is actually installed in a color television display tube.

The oxide layer 3 comprising at least one oxide of a reducing element such as Zr, Ti, Al, Si, Mg, U, Th, Cr, Nb, or the like is coated on the base metal plate 1, and the carbon coating layer 4 is coated on the oxide layer 3, so that the interfacial reaction between the base metal and the alkaline earth oxides can completely be suppressed. (Hereinafter, both the oxide layer 3 and the carbon coating layer 4 in combination can be termed as "surface double layers".)

The base metal plate 1 is made of an alloy comprising 2% by weight or more and preferably less than a solid solubility limit in nickel, more preferably 30% by weight or less of at least one high-melting point metal such as tungsten, molybdenum, rhenium, tantalum, or the like, if necessary a small amount of at least one reducing element such as magnesium, silicon, zirconium or the like, and the remainder being nickel. Examples of such alloys are as follows (weight percents of individual elements being shown in the parentheses).

| | |
|---|---|
| Ni-W-Mg | (72.4 : 27.5 : 0.1) |
| Ni-W-Mo-Mg | (80.9 : 2.0 : 17.0 : 0.1) |
| Ni-W-Re-Mg | (82.9 : 2.0 : 15.0 : 0.1) |
| Ni-W-Mo-Re-Mg | (80.1 : 2.0 : 15.8 : 2.0 : 0.1) |
| Ni-W-Si | (72.4 : 27.5 : 0.1) |
| Ni-W-Mo-Si | (80.9 : 2.0 : 17.0 : 0.1) |
| Ni-W-Re-Si | (82.9 : 2.0 : 15.0 : 0.1) |
| Ni-W-Mo-Re-Si | (80.1 : 2.0 : 15.8 : 2.0 : 0.1) |
| Ni-W-Zr | (72.1 : 27.5 : 0.4) |
| Ni-W-Mo-Zr | (80.6 : 2.0 : 17.0 : 0.4) |
| Ni-W-Re-Zr | (82.6 : 2.0 : 15.0 : 0.4) |
| Ni-W-Mo-Re-Zr | (79.8 : 2.0 : 15.8 : 2.0 : 0.4) |

One or more other reducing elements such as Al, Ti, U, Cr, Nb, Th and the like can be used together with or in place of the above-mentioned Zr, Mg and Si. In the case of Zr, it is preferable to use it in an amount of 5% by weight or less based on the weight of the alloy. In the case of other reducing elements, an impurity amount of such a reducing element, i.e. corresponding to an amount contained in a conventional base metal as an impurity, is usually used.

The high-melting point metals such as W, Mo, Re, and Ta are preferably used in amounts within their solid solubility limit in nickel. When at least one high-melting point metal is contained in the base metal more than its solid solubility limit in nickel, the desired base metal plate may be produced with difficulty, if obtained. Such a base metal plate may be brittle, poor in workability and easily be deformed by repeated heating and cooling. On the other hand, when the content of the high-melting point metal is less than 2% by weight, the resulting base metal plate may be poor in electrical resistance and mechanical strength.

The oxide layer 3 coated on the flat portion 6 of the base metal plate 1 comprises at least one oxide of a reducing element such as Zr, Al, Mg, Si, Ti, U, Cr, Nb, Th or the like. One or more reducing elements not oxidized, carbides of reducing elements, oxides of nickel can be included therein.

The oxide layer 3 can be produced on the base metal plate 1 which contains one or more reducing elements by uniformly spreading an oxide or a mixture of two or more oxides of reducing elements on the base metal plate, and subsequently either heating the base metal plate at 600° to 1000° C. for about 5 to 60 minutes under an atmosphere of an inert gas such as hydrogen, nitrogen, argon, helium, or the like containing a very small amount of an oxidative gas such as $CO_2$, $H_2O$, $O_2$ or the like, or heating the base metal plate in a conventional vacuum heat treatment furnace under a pressure of $10^{-4}$ to $10^{-6}$ Torr at 600° to 1200° C. for about 10 to 60 minutes. In the case where the base metal contains no reducing element, at least one oxide of reducing element as mentioned above is coated on the base metal plate by a conventional method such as sputtering.

The oxide layer has a sufficient thickness to function effectively such as to control the reaction between the overlaid carbon coating layer and the base metal plate and to maintain activity of the cathode sufficiently during the operation of the oxide-coated cathode.

The thickness of the oxide layer is preferably from 50 to 1000 Å, more preferably 400 to 700 Å. If the oxide layer is too thin, the overlaid carbon coating layer reacts with the base metal plate during the operation of the cathode and produces a highly active state on the surface of the base metal palte, which results in making the reaction between the alkaline earth oxide layer and the base metal plate greater, or in the case of sticking metal powder such as Ni, Ni-Co, Ni-W, Ni-Mo, or Ni-Re powder on the base metal plate in order to increase the bonding strength, the metal powder in the particle form flows on the base metal plate. If the oxide layer is too thick, the overlaid carbon coating layer reacts with the alkaline earth oxides or $CO_2$gas produced by decomposition of the alkaline earth carbonates and disappears, which results in making activity of the cathode insufficient due to bad contact between the metal elements in the base metal palte and the alkaline earth oxide layer. Therefore, so far as the thickness of the oxide layer is preferably in the range of 50 to 1000 Å, more preferably 400 to 700 Å, the oxide of reducing element properly covers the surface of the base metal plate even after the carbon coating layer disappears and a part of the metal elements in the base metal palte are exposed on the surface of the base metal plate, so that activity on the surface of the base metal plate becomes proper and a stable and good cathode can be obtained.

On the oxide layer 3, the carbon coating layer 4 is coated. The carbon coating layer has a sufficient thickness to function effectively such as to suppress the reaction between the base metal and the alkaline earth carbonates or oxides during the production of the oxide-coated cathode and to maintain sufficient performance of the oxide-coated cathode by controlling the reactions between the base metal plate and the carbon coating layer and between the alkaline earth oxide layer and the carbon coating layer during the operation of the cathode. The thickness of the carbon coating layer is preferably from 50 to 700 Å. In order to produce the carbon coating layer, there can be used such a method as an ion plating method using $CH_4$ gas, a vacuum evaporation method, pyrolysis of a hydrocarbon, or the like. In the case of the ion plating method using $CH_4$ gas, for example, a carbon coating layer can be obtained at a rate of about 40 Å/min by charging a voltage (DC) of 600 V on a substrate in $CH_4$ gas under 0.1 Torr.

If the thickness of the carbon coating layer is too small, the reaction between the base metal and the alkaline earth carbonates or oxides cannot be suppressed during the production of an oxide-coated cathode. On the other hand, if the thickness is too large, reaction amounts between the carbon coating layer and the base metal plate, and between the carbon coating layer and the alkaline earth oxide layer become larger, so that sufficient operation of the cathode cannot be expected. Therefore, so far as the thickness of the carbon coating layer is preferably in the range of 50 to 700 Å, there can be obtained an excellent cathode in which the interfacial reaction between the alkaline earth oxides and the base metal is suppressed and the reaction amounts between the alkaline earth oxide layer and the carbon coating layer, and between the carbon coating layer and the base metal plate are reduced remarkably.

The alkaline earth oxide layer 5 being capable of emitting electrons is coated on the carbon coating layer 4 using a conventional method, in order to produce an oxide-coated cathode for electron tubes.

According to the present invention, if metal powder such as Ni, Ni-Co, Ni-W, Ni-Mo, Ni-Re, or the like powder is sticked on the surface of the flat portion of the base metal plate so as to prevent the alkaline earth oxide layer from peeling from the base metal plate, there can be obtained various advantages in that flowing out of the metal powder in the particle form on the surface of the base metal plate can be prevented, the reaction between the metal powder and the interfacial reaction products can be prevented, change in quality and deformation of the metal powder usually taking place can be prevented, and electron emission life of the resulting oxide-coated cathode can be prolonged, by sandwiching the metal powder between the base metal plate and the oxide layer.

The present invention will be explained in more detail by way of the following Examples.

EXAMPLE 1

On the surface of a base metal plate made of an alloy consisting of 0.4% by weight of Zr, 27.5% by weight of W and 72.1% by weight of Ni, there was coated one of five kinds of combinations of oxide layers and carbon coating layers having thickness as shown in Table 1 (A, C, D, E and F), and an alkaline earth oxide layer was coated thereon according to a conventional method to give an oxide-coated cathode, which was actually installed in a color television display tube. Thickness of each oxide layer ($ZrO_2$) was adjusted by changing heating time at 900° C. under a pressure of $1\times10^{-5}$ Torr. Each carbon coating layer was produced by an ion plating method using $CH_4$ gas under 0.1 Torr and thickness thereof was controlled by ion plating time.

Table 1

| Kind | Thickness of oxide layer (Å) | Thickness of carbon coating layer (Å) |
|---|---|---|
| A | 550 | 250 |
| B | 0 | 0 |
| C | 70 | 100 |

Table 1-continued

| Kind | Thickness of oxide layer (Å) | Thickness of carbon coating layer (Å) |
|---|---|---|
| D | 700 | 1000 |
| E | 0 | 40 |
| F | 600 | 0 |

Figure 2:
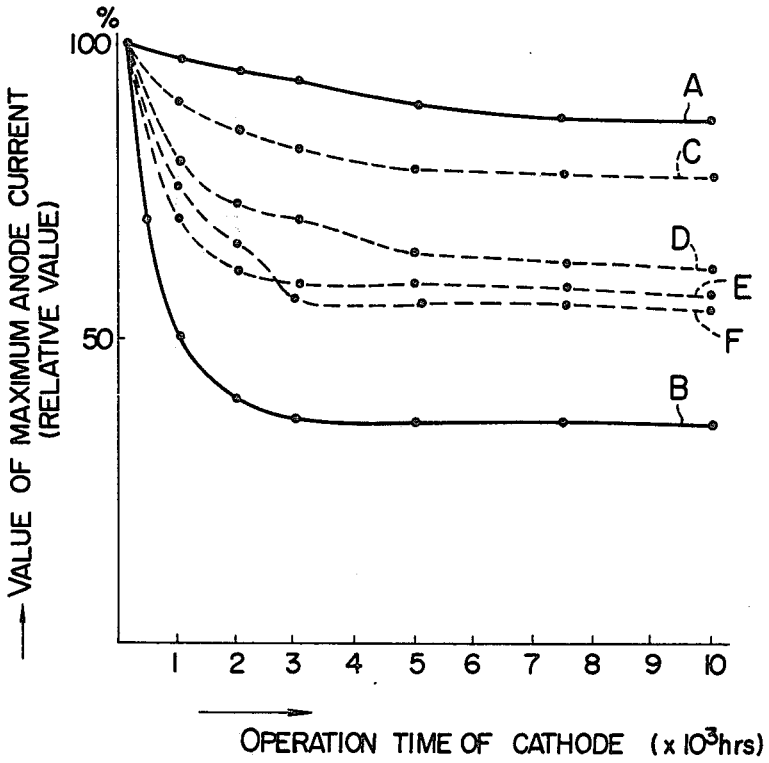

The attached FIG. 2 shows dependence of a maximum anode current on operating time of the cathode installed in the color television display tube. In FIG. 2, ratio of maximum current to the initial value at the anode is taken on the vertical axis and operating time of the cathode is taken on the horizontal axis. The symbols A to F in FIG. 2 correspond to the kinds of A to F in Table 1.

As is clear from FIG. 2, the cathodes having the oxide layer within the range of 50–1000 Å in thickness and the carbon coating layer within the range of 50–700 Å in thickness show the remarkably excellent property as shown in the curves A and C, whereas as shown in the curves E and F the cathodes having only an oxide layer or a carbon coating layer show the poor property. When the cathode has both the oxide layer and the carbon coating layer, although the latter is rather too thick, as shown in the curve D, it shows better results than those of the kinds E and F. Particularly, as shown in the curve B, the cathode containing neither oxide layer nor carbon coating layer shows remarkably great deterioration in electron emission. These results clearly show excellent effects of the present invention.

EXAMPLE 2

On one of four kinds of base metal plates G, H, I and J as shown in Table 2, an oxide layer of 500 to 700 Å in thickness (G: $SiO_2$, H and J: $ZrO_2$, and I:MgO) and a carbon coating layer of 200 to 300 Å in thickness, and an alkaline earth oxide layer were coated in this order to produce in the same manner as described in Example 1 an oxide-coated cathode, which was installed in a color television display tube. For comparison, oxide-coated cathodes containing no oxide layer nor carbon coating layer were also produced similarly and installed in color television display tubes.

Table 2

| Kind | Composition of base metal |
|---|---|
| G | Si 0.07% wt., W 2% Wt., Re 15% wt., Ni 82.93% wt. |
| H | Zr 0.4% wt., W 27.5% wt., Ni 72.1% wt. |
| I | Mg 0.1% wt., W 2% wt., Mo 17% wt., Ni 80.9% wt. |
| J | Ni power was sticked on the base metal of kind H |

Figure 3:
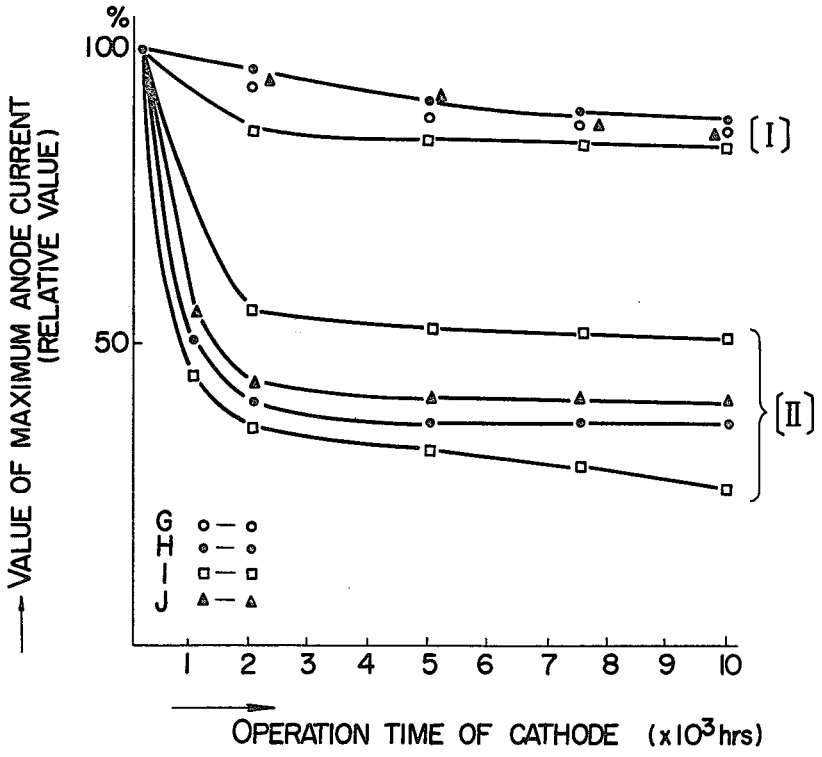

FIG. 3 shows effects of the compositions of base metals on electron emission with the lapse of operation time of the cathodes, wherein the curves in the group [I] are obtained from the cathodes having both the oxide and carbon coating layers and the curves in the group [II] are obtained from the cathodes having no oxide and carbon coating layers.

As shown in FIG. 3, the cathodes of the present invention having both the oxide and carbon coating layers show very little deterioration in electron emitting amounts during the usage (group [I]) even though the compositions of the base metals are changed greatly. On the other hand, the cathodes having no surface double layers according to the present invention, as shown in group [II], are greatly influenced by the compositions of the base metals and show much deterioration in electron emitting amounts during the usage.

As mentioned above, the surface double layers according to the present invention give remarkably great effects on oxide-coated cathodes using as a base metal an alloy comprising one or more high-melting point metals, irrespective of considerable changes in the composition of the base metal.

According to the present invention, there can be obtained the oxide-coated cathodes which can prevent deterioration in electron emissive ability during the usage of the cathodes and can maintain a proper electron emission amount for a long period of time. Therefore extremely excellent effects can be obtained in increasing quality of electron tubes and reliability placed thereon according to the present invention.

What is claimed is:

1. An oxide-coated cathode for electron tubes which comprises a base metal plate made of an alloy comprising nickel as a main component and 2% by weight or more of at least one high-melting point metal, an oxide layer, which is coated on the base metal plate, comprising at least one oxide of a reducing element, a carbon coating layer which is coated on the oxide layer, and an electron emissive alkaline earth oxide layer coated on the carbon coating layer.

2. An oxide-coated cathode for electron tubes according to claim 1, wherein the oxide layer has a sufficient thickness to control the reaction between the overlaid carbon coating layer and the base metal plate and to maintain activity of the cathode, and the carbon coating layer has a sufficient thickness to maintain sufficient performance of the cathode by controlling the reactions between the base metal plate and the carbon coating layer and between the alkaline earth oxide layer and the carbon coating layer.

3. An oxide-coated cathode for electron tubes according to claim 1, wherein the oxide layer has a thickness of 50 to 1000 Å and the carbon coating layer has a thickness of 50 to 700 Å.

4. An oxide-coated cathode for electron tubes according to claim 1 or 2, wherein the oxide layer has a thickness of 400 to 700 Å.

5. An oxide-coated cathode for electron tubes according to claim 1, wherein the high-melting point metal is at least one member selected from the group consisting of tungsten, molybdenum, rhenium and tantalum.

6. An oxide-coated cathode for electron tubes according to claim 1, wherein the alloy which makes of the base metal plate further contains one or more of reducing elements selected from the group consisting of zirconium, aluminum, magnesium, silicon, titanium, uranium, chromium, niobium and thorium.

7. An oxide-coated cathode for electron tubes according to claim 1 or 5, wherein the base metal plate is made of an alloy of Ni-W-Mg, Ni-W-Mo-Mg, Ni-W-Re-Mg or Ni-W-Mo-Re-Mg.

8. An oxide-coated cathode for electron tubes according to claim 1 or 5, wherein the base metal plate is made of an alloy of Ni-W-Si, Ni-W-Mo-Si, Ni-W-Re-Si or Ni-W-Mo-Re-Si.

9. An oxide-coated cathode for electron tubes according to claim 1 or 5, wherein the base metal plate is made of an alloy of Ni-W-Re-Zr, Ni-W-Zr, Ni-W-Mo-Zr or Ni-W-Mo-Re-Zr.

10. An oxide-coated cathode for electron tubes according to claim 1, wherein the oxide of a reducing element in the oxide layer is at least one oxide of a reducing element selected from the group consisting of zirconium, aluminum, magnesium, silicon, titanium, uranium, chromium, niobium and thorium.

11. An oxide-coated cathode for electron tubes according to claim 1, wherein the carbon coating layer is produced from carbon or a hydrocarbon.

12. An oxide-coated cathode for electron tubes according to claim 1, wherein metal powder of Ni, Ni-Co, Ni-W, Ni-Mo or Ni-Re is sandwiched between the base metal plate and the oxide layer.

13. A process for producing an oxide-coated cathode for electron tubes which comprises coating an oxide layer of at least one oxide of a reducing element of 50 to 1000 Å in thickness on a base metal plate made of an alloy comprising nickel as a main component and 2% by weight or more of at least one high-melting point metal, coating a carbon coating layer of 50 to 700 Å in thickness on the oxide layer, and coating an alkaline earth oxide layer capable of emitting electrons on the carbon coating layer.

* * * * *